United States Patent [19]

Gorman

[11] Patent Number: 4,530,867

[45] Date of Patent: Jul. 23, 1985

[54] SELF-ADHERING MEMBERS

[76] Inventor: Edith C. Gorman, 485 Bennetts Farm Rd., Ridgefield, Conn. 06877

[21] Appl. No.: 543,015

[22] Filed: Oct. 18, 1983

[51] Int. Cl.[3] ..... B32B 27/06; B32B 27/08; B32B 27/10

[52] U.S. Cl. ..... 428/41; 428/198; 428/343; 428/914

[58] Field of Search ..... 428/40, 41, 35, 900, 428/914, 198, 343

[56] References Cited

U.S. PATENT DOCUMENTS

| | | | |
|---|---|---|---|
| 2,096,389 | 10/1937 | Bode | 428/41 |
| 3,093,502 | 6/1963 | Drelich | 428/198 |
| 3,311,338 | 3/1967 | Culley | 428/40 X |
| 3,350,045 | 10/1967 | Mayers | 428/14 X |
| 3,503,835 | 3/1970 | Hermann | 428/41 |
| 3,546,053 | 12/1970 | Goldberg et al. | 428/41 X |
| 3,987,569 | 10/1976 | Chase | 428/41 X |

*Primary Examiner*—Thomas J. Herbert

*Attorney, Agent, or Firm*—Bollo & Drumm

[57] ABSTRACT

Self-adhering members in the form of eating accessories or a pattern component including a plastic or paper member having a predetermined configuration for holding solid or liquid food or in the form of a pattern component for making a specific article of clothing from fabric, the member having an upper surface and a lower surface, the lower surface being dimensioned to support the member when the member is placed on a supporting surface, a plurality of adhesive segments affixed to the lower surface for adhering to the supporting surface when placed in pressure contact therewith, the plurality of adhesive segments being arranged on the lower surface substantially parallel to one another, and peelable adhesive strips overlying the plurality of parallel adhesive segments to prevent adherence of the member to an object until the peelable adhesive strips are removed from the member exposing the adhesive segments and the plurality of exposed adhesive segments are placed in pressure contact with the supporting surface.

5 Claims, 7 Drawing Figures

Fig. 1.
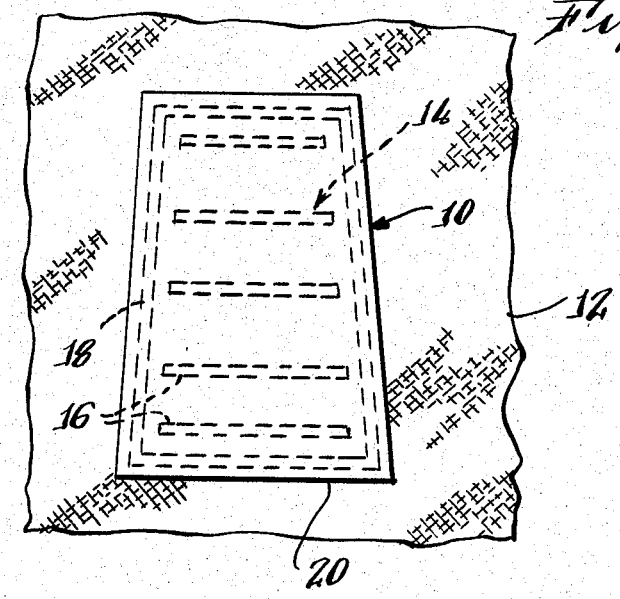
Fig. 2.
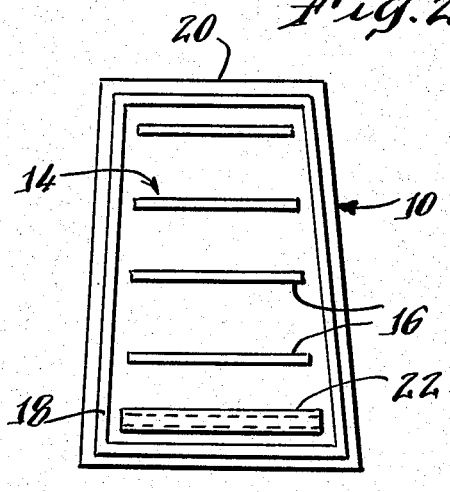
Fig. 3.
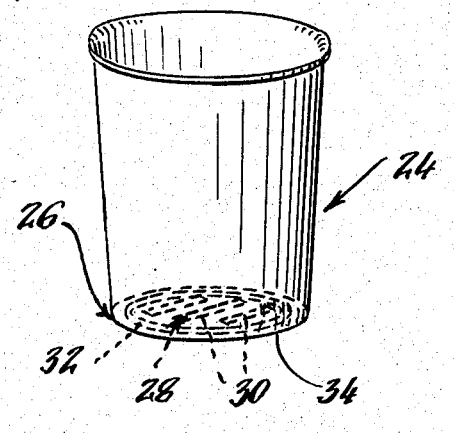
Fig. 5.
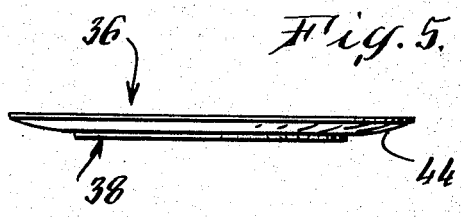
Fig. 6.
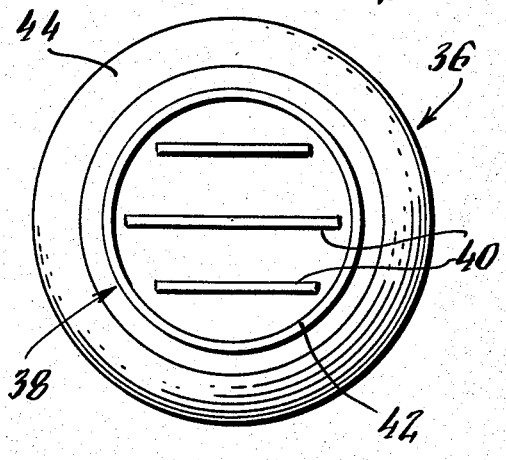
Fig. 4.
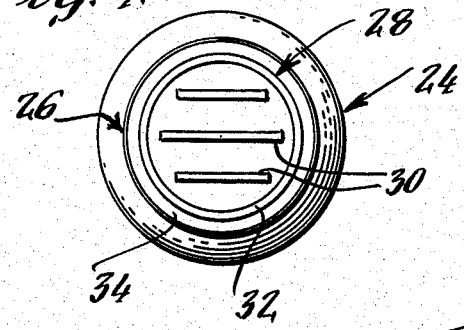
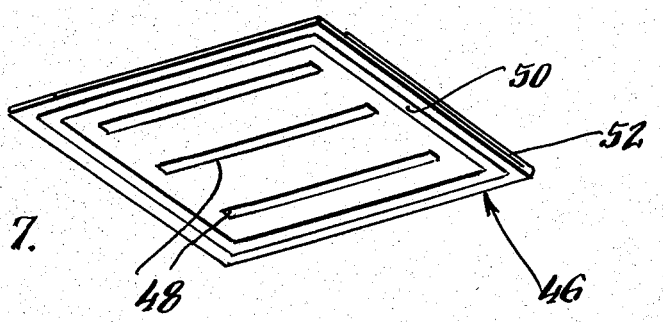
Fig. 7.

SELF-ADHERING MEMBERS

BACKGROUND OF THE INVENTION

The present invention relates to self-adhering members and more particularly to self-adhering eating accessories in the form of paper or plastic cups, plates and napkins, and patterns for making articles of clothing from fabric.

Since eating accessories in the form of paper or plastic plates, cups and napkins are light in weight various problems result in usage. This is particularly true when utilizing paper or plastic (styrofoam) cups and plates outdoors where they encounter wind. In the presence of the force of the wind, the plates or cups, particularly when not full, are often moved from their resting place, such as a picnic table or other supporting member, and sometimes blown away. Further, the light weight of paper napkins often leads to their also being blown away or falling off the lap of an individual during movement. Further, when making clothing it is the typical practice to pin a paper pattern component to the fabric to maintain the pattern component in position on the fabric prior to cutting the pattern configuration from the fabric. This technique of using pins is not only time consuming but dangerous to the individual doing the pinning in that his or her fingers may be punctured, to say nothing of the danger to children playing in the fabric work area who may come in contact with the pins.

SUMMARY OF THE INVENTION

It is an object of the present invention to provide self-adhering members in the form of paper and plastic napkins, plates, and cups.

It is a further object of the present invention to provide self-adhering members in the form of paper pattern components.

It is a further object of the present invention to maintain the position of paper and plastic cups and plates when the same are used outdoors.

It is a further object of the present invention to maintain the position of a paper napkin when placed on the lap of a user.

It is a further object of the present invention to provide a self-adhering pattern which eliminates the need to use pins.

Briefly, in accordance with the present invention, self-adhering members are provided in the form of eating accessories or a pattern component including a plastic or paper member having a predetermined configuration for holding solid or liquid food or drink or in the form of a pattern component for making a specific article of clothing from fabric, the member having an upper surface and a lower surface, the lower surface being dimensioned to support the member when the member is placed on a supporting surface, a plurality of adhesive segments affixed to the lower surface for adhering to the supporting surface when placed in pressure contact therewith, the plurality of adhesive segments being arranged on the lower surface substantially parallel to one another, and peelable adhesive strips overlying the plurality of parallel adhesive segments to prevent adherence of the member to an object until the peelable adhesive strips are removed from the member exposing the adhesive segments and the plurality of exposed adhesive segments are placed in pressure contact with the supporting surface.

Other objects, aspects and advantages of the present invention will be apparent from the detailed description considered in conjunction with the drawings, as follows:

BRIEF DESCRIPTION OF THE DRAWINGS

FIG. 1 is a top plan view of a self-adhering pattern in accordance with the present invention positioned on a fabric;

FIG. 2 is a bottom plan view of the self-adhering pattern of FIG. 1 showing the position of the adhesive arranged thereon;

FIG. 3 is a side elevational view of a paper cup;

FIG. 4 is a bottom plan view of the cup of FIG. 3 showing the position of the adhesive arranged thereon;

FIG. 5 is a side elevational view of a paper plate;

FIG. 6 is a bottom plan view of the paper plate of FIG. 5 showing the position of the adhesive arranged thereon; and FIG. 7 is a bottom plan view of an unfolded paper napkin showing the position of the adhesive arranged thereon.

DETAILED DESCRIPTION

Referring to FIG. 1, a pattern component 10 in the form of a skirt is shown positioned on a fabric 12. Shown in dotted outline are the adhesive segments 14. The adhesive segments 14 are shown more clearly in FIG. 2. The adhesive segments 14 include a plurality of discrete segments 16 arranged substantially parallel to one another and perpendicular to the longitudinal axis of the pattern 10 and a plurality of segments 18 substantially conforming to the periphery 20 of the pattern component 10 but spaced inwardly therefrom. Advantageously, the adhesive may include any pressure sensitive adhesive such as double faced tape. Advantageously, peelable coverings or strips overlie the adhesive, only one of which is shown and designated as 22 in FIG. 1. However, it should be understood that all of the adhesive segments 16 and 18 are initially overlaid with peelable coverings 22, including the embodiments illustrated in FIGS. 3 through 7.

Referring to FIG. 3, a standard shaped paper or plastic cup 24 is illustrated. However, as seen in FIG. 4 the bottom 26 of the cup 24 includes a plurality of discrete segments 28 formed thereon. The adhesive segments 28 include a plurality of discrete segments 30 arranged substantially parallel to one another and a plurality of segments 32 substantially conforming to the periphery 34 of the bottom 26 of the cup 24, but spaced inwardly therefrom.

FIG. 5 illustrates a plate 36 which may be paper or plastic, e.g., styrofoam, as desired. As shown in FIG. 6, the plate 36 includes a plurality of adhesive segments 38. The discrete adhesive segments 38 include a plurality of spaced segments 40 arranged substantially parallel to one another and a plurality of segments 42 substantially conforming to the periphery 44 of the plate 36 but spaced inwardly therefrom.

Finally, FIG. 7 illustrates a napkin 46 which may be paper or plastic and includes a plurality of discrete adhesive segments 48 which are arranged substantially parallel to one another and substantially perpendicular to an axis of the napkin 46. Advantageously, the napkin 46 also includes a plurality of segments 50 substantially conforming to the periphery 52 of the napkin 46 but spaced inwardly therefrom.

As previously stated, all of the discrete adhesive segments illustrated in the FIGS. 1–7 will initially include peelable adhesive coverings 22 of the type illustrated in FIG. 2 for packaging and shipment and to prevent adherence of the members to an object when not in use, as well as for possibly recovering the adhesive segments for reuse, particulary with the pattern components. A consumer desiring to use the pattern component 10 illustrated in FIGS. 1 and 2, or the eating accessories illustrated in FIGS. 3–7, simply removes the peelable coverings 22 by peeling the same away from adhesive segments and places the pattern component 10, or eating accessories 24, 36 or 46 into pressure engagement with a supporting member, such as fabric or a picnic table so that the pressure sensitive adhesive will adhere thereto normally preventing movement of the pattern component 10 or the eating accessories 24, 36 or 46. Thus, a pattern component can be properly positioned on the fabric 12 without the need to use pins which is time consuming and often results in puncturing of the hands of the clothes maker and/or any children in the work area who come in contact with the pins. Additionally, the eating accessories 24, 36, and 46 can be positioned on a supporting member and held thereby so that the eating accessories do not move in the presence of wind gusts or fall off the lap of a user during movement. However, the member can be readily removed from the supporting member or fabric by an individual by gripping the member and repeeling it from the supporting member or fabric so that items such as paper or plastic cups, plates and napkins, as well as pattern components, can be reused, if desired.

It should be apparent to those skilled in the art that various modifications may be made in the present invention without departing from the spirit and scope thereof as described in the specification and defined in the appended claims.

What is claimed is:

1. A self-adhering member in the form of an eating accessory or pattern component, comprising:

a lightweight plastic or paper member having a specific configuration for holding solid or liquid food or in the form of a pattern component for making a specific article of clothing from fabric;

each said member having an upper surface and a lower surface, said lower surface being dimensioned to support said member when said member is placed on a supporting surface;

a first group of rectangularly shaped adhesive segments including a plurality of discrete rectangularly shaped adhesive segments affixed to said lower surface for adhering to the supporting surface when placed in pressure contact therewith, said rectangularly shaped discrete adhesive segments being arranged on said lower surface substantially parallel to one another;

a second group of contiguous adhesive segments affixed to said lower surface and spaced inwardly from the periphery of said member in a pattern substantially conforming to the configuration of the periphery of said member; and peelable adhesive strips overlying said adhesive segments to prevent adherence of said member to an object until said peelable adhesive strips are removed from said member exposing said adhesive segments and said exposed adhesive segments are placed in pressure contact with the supporting surface.

2. The self-adhering member recited in claim 1, wherein:

said member is a plate.

3. The self-adhering member recited in claim 1, wherein:

said member is a pattern component for making clothing.

4. The self-adhering member recited in claim 1, wherein:

said member is a cup.

5. The self-adhering member recited in claim 1, wherein:

said member is a napkin.

* * * * *